United States Patent [19]

Labick et al.

[11] Patent Number: 4,530,129

[45] Date of Patent: Jul. 23, 1985

[54] DISPOSABLE TOOTHBRUSH

[76] Inventors: Richard A. Labick, c/o George Spector, 3615 Woolworth Bldg, 233 Broadway; George Spector, c/o Richard A. Labick, 3615 Woolworth Bldg., 233 Broadway, both of, New York, N.Y. 10007

[21] Appl. No.: 421,469

[22] Filed: Sep. 22, 1982

[51] Int. Cl.[3] ..... A46B 9/04

[52] U.S. Cl. ..... 15/184; 132/84 B; 206/63.5; 206/362.3; 206/804

[58] Field of Search ..... 15/184; 132/84 R, 84 A, 132/84 B, 84 C, 84 D, 90; 206/361, 362, 362.1, 362.2, 362.3, 63.5, 804, 813, 460

[56] References Cited

U.S. PATENT DOCUMENTS

| | | | |
|---|---|---|---|
| 1,343,570 | 6/1920 | Lieberthal | 15/184 X |
| 1,349,110 | 8/1920 | Snyder | 132/84 A |
| 1,604,918 | 10/1926 | King | 15/184 |
| 1,637,153 | 7/1927 | Lawton | 206/63.5 |
| 1,691,814 | 11/1928 | King | 15/184 |
| 1,841,761 | 1/1932 | Priest | 132/84 A |
| 1,971,843 | 8/1934 | Alilaire | 206/63.5 |
| 2,233,522 | 3/1941 | Fickle | 15/184 |
| 2,438,641 | 3/1948 | Loehr | 15/184 |
| 3,923,239 | 12/1975 | Lee | 206/804 |
| 4,152,804 | 5/1979 | Morris | 15/184 |

FOREIGN PATENT DOCUMENTS

| | | | |
|---|---|---|---|
| 405775 | 11/1909 | France | 206/361 |

*Primary Examiner*—Peter Feldman

[57] ABSTRACT

A disposable toothbrush assembly, including a wrapper containing an inexpensively made toothbrush, a small amount of toothpaste and a short length of rolled up dental floss, so to form an inexpensive package.

1 Claim, 9 Drawing Figures

DISPOSABLE TOOTHBRUSH

This invention relates generally to toothbrushes. More specifically it relates to toothbrushes of disposable type.

It is well known that a proper care of teeth and mouth hygiene requires the brushing of the teeth after every meal. This rule is of course not practiced by most persons who go to school or to work, so are obliged to neglect such care after a lunch away from home. The carrying of a persons personal toothbrush and toothpaste back and fourth seems to be to much of a chore and is not practiced. This situation is objectionable, and is therefore in need of an improvement.

Accordingly, it is a principal object of the present invention to provide a disposable toothbrush, so that after a single use, it may be discarded, and need not be carried any further, and wherein the toothbrush is provided with a small quantity of toothpaste, enough for only a single use, or only a few time use, so that no bulky toothpaste tube need to carry at all.

Another object is to provide a disposable toothbrush which accordingly would be also ideal for use on only a single overnight travel trip away from home, and could fit comfortably in a pocket or purse so to not take up luggage space such as a conventional reusable toothbrush and a separate tube of toothpaste.

Another object is to provide a disposable toothbrush which can be stored in a car glove compartment, similarly to paper napkins for handy use when needed, or which can be taken on picnics or camping trips, and which could be dispensed from a vending machine or provided as a courtesy by motels and hotels to guests.

Figure 3:
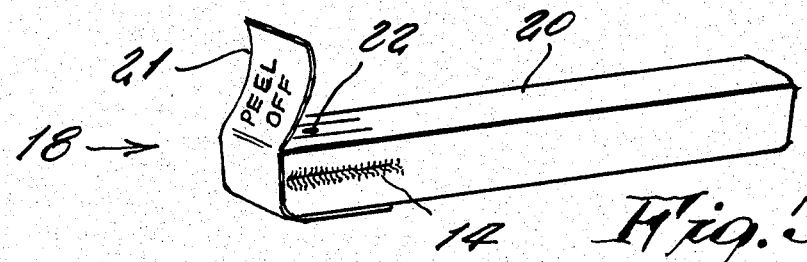
FIG. 3 shows another design of the invention which is smaller in size so to more easily fit in a pocket or purse, but having a telescopic handle which in a closed position encloses the brush bristles, paste and floss, the brush being less expensively made so to be quickly disposable as shown in FIG. 4.
Figure 4:
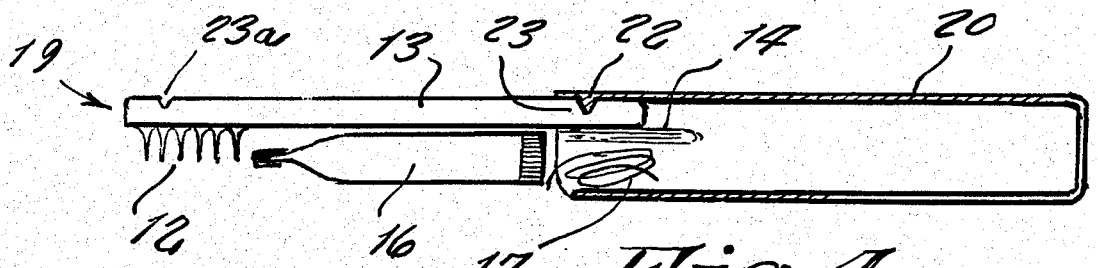
FIG. 4 is a cross section of the model of FIG. 3, with handle shown extended.

Referring now to FIGS. 3 and 4, another design of disposable toothbrush 18 shows a short handled toothbrush 19 that is similarly made as the above described toothbrush 11, but which by being made with a shorter handle, can be carried in a small space in a purse or pocket, in addition to saving on material. The toothbrush 19 is retailed inside a plastic tube 20 together with the tube of toothpaste 16 and the dental floss 17, the tube having a tab 21 glued across its open end and which serves as an inexpensive closure, when being retailed, and which afterwards is simply peeled off so to pull out the tube content. In using the toothbrush 18, it is only pulled partially out of the tube, until a spur 22 formed on an inner wall of the tube snaps into a notch 23 formed on the toothbrush handle so that the tube thus forms a handle extension for being conveniently held in a hand when using the toothbrush. Thus the tube serves as double purpose, as shown, the tube may be square shaped and includes inward ribs 14 on opposite sides so to hold the toothbrush handle in position for engaging the spur 22. A second notch **23*a*** retains the brush retracted inside the tube.

Figure 1:
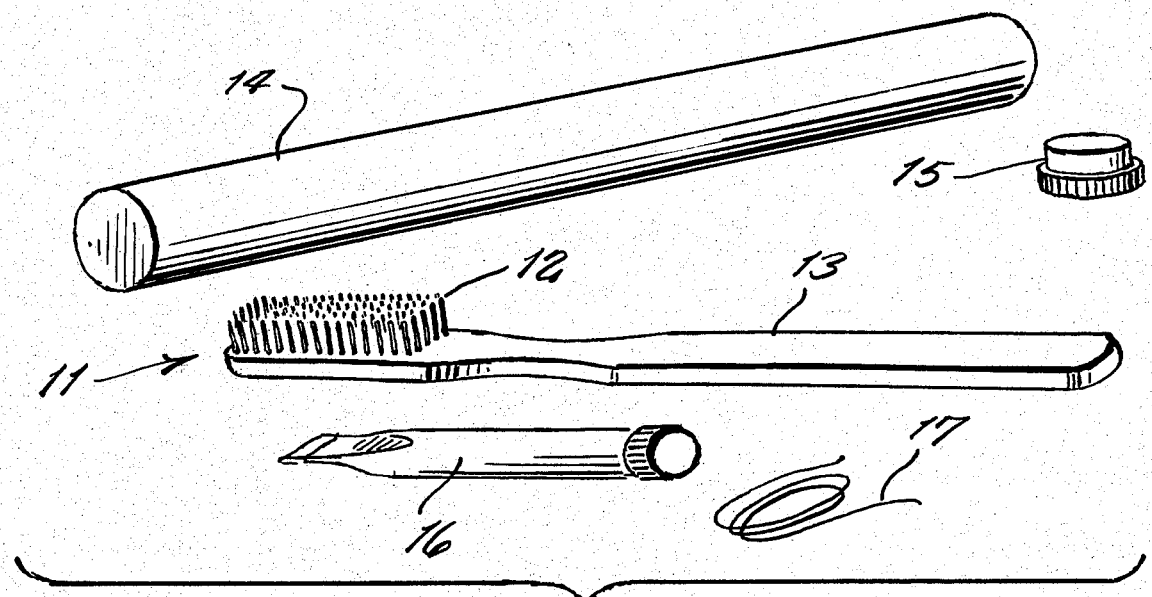
FIG. 1 is a perspective view of one design of the invention, shown with components removed from the case.
Figure 2:
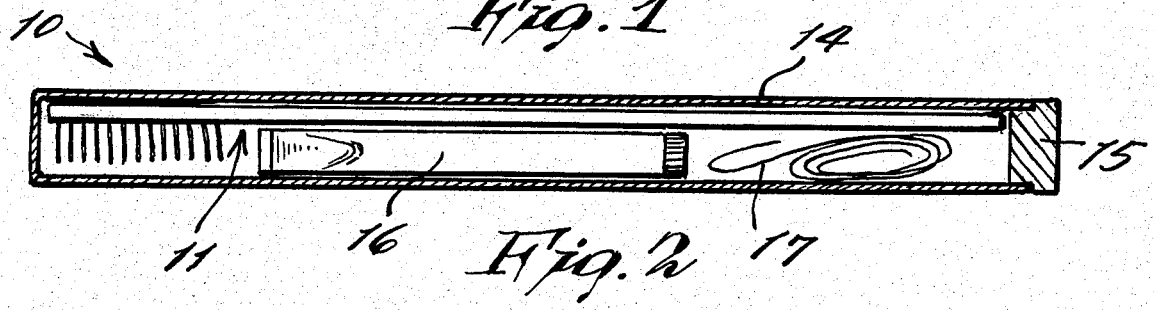
FIG. 2 is a cross sectional view of the case, showing the components assembled inside.
Figure 5:
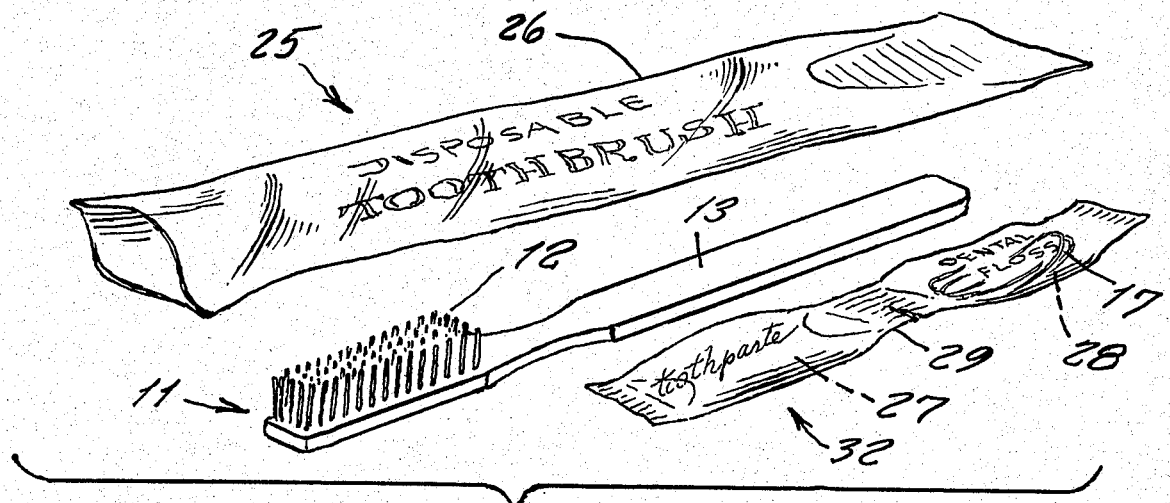
FIG. 5 is a perspective view of a modified design of the model that is illustrated in FIG. 1, and which substitutes inexpensive thin, polyethylene wrappers for the molded plastic parts.
Figure 6:
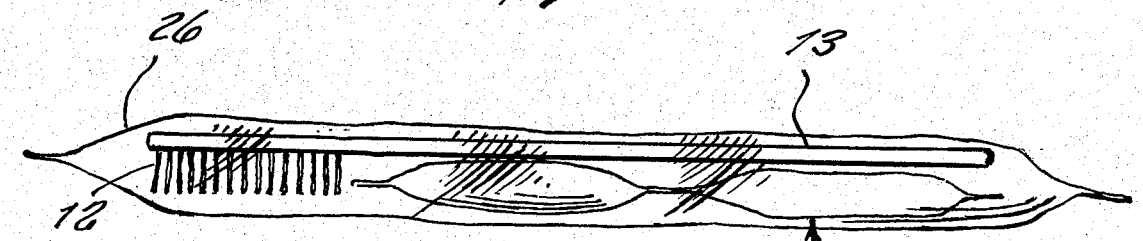
FIG. 6 is a side view thereof shown assembled as a package.

Referring now to FIGS. 5 and 6, another model 25 of the invention is shown, which differs from the model 10 shown in FIGS. 1 and 2, by substituting the above-described, molded plastic case 14 and molded plastic cap 15 by a simple, inexpensive wrapper 26 made in the form of an envelop and which is made from a thin polyethylene material. As shown, labeling may be printed upon the wrapper, such as in conventionally done. Also in this model 25, the toothpaste and the dental floss 17 are contained in sealed pockets 27, and 28 formed by heat sealing along a tubular strip of wrapper 29, made also of inexpensive, thin polyethylene material which is same as the wrapper 26. Thus the model 25 is less costly to manufacture and less expensive for purchase due to elimination of molded parts 14, and 15 as well as the molded screw cap on the threaded neck of the toothpaste tube 16 shown in FIG. 1.

Figure 7:
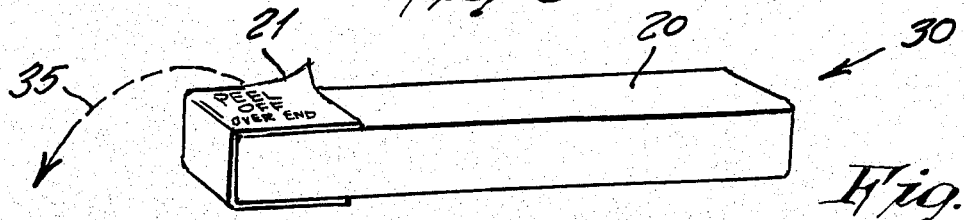
FIG. 7 is a perspective view of a modified design of the model that is illustrated in FIG. 3.
Figure 8:
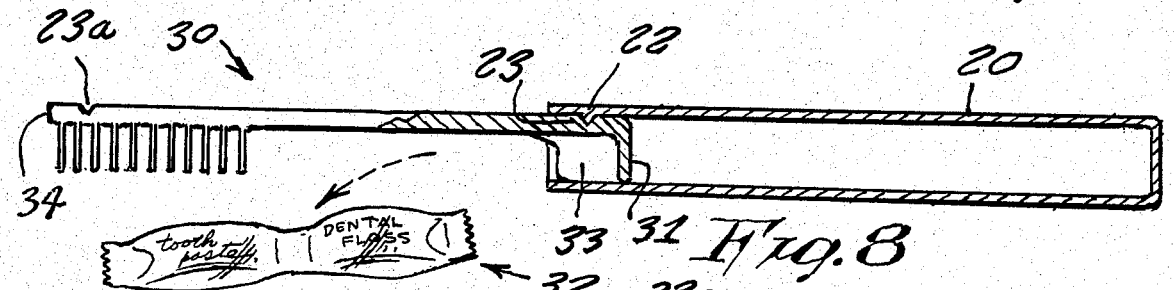
FIG. 8 is a cross sectional view thereof shown with the handle extended.
Figure 9:
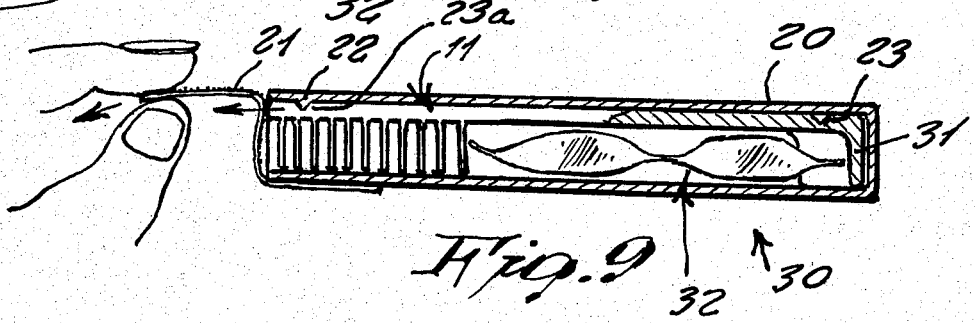
FIG. 9 is a similar view thereof shown with the handle retracted.

Referring now to FIGS. 7,8 and 9, there is shown a modified model 30 of the toothbrush 18 shown in FIGS. 3 and 4. The model 130 includes an end wall 31 formed on an end of the toothbrush handle 13 so that when the brush is pulled outwardly from the inner end of the tube 20, the end wall 31 pulls the packet 32 of toothpaste and dental floss (which is described in detail in FIGS. 5 and 6), so to prevent the packet getting stuck inside the inner end of the tube 20. The end wall 31 may be made integral with additional short side walls 33 which serve to bear against the tube wall located opposite to the spur 22 in order to retain the toothbrush in a straight line when telescoped into its extended position, and which accordingly eliminates need of the inward bead 14 shown in FIGS. 3 and 4. The model 30, by including the packet 32, made of thin wrapper material, is thus also less expensive. The pressure sensitive adhesive on the tab 21, across the open end of the tube 20 also adheres to an end edge 34 of the toothbrush so that when the tab is peeled off over the tube end, as shown by arrow 35, the tab thus pulls the brush partly out of the tube, so to be easily grasped between a person's fingers and pulled fully into its operative, extended position.

What is claimed, as new is:

1. A disposable toothbrush with front and rear ends and storage tube with an end wall comprising in combination a toothbrush with a handle slideably engaging said tube, a toothpaste container and dental floss stored alongside said toothbrush in said tube, means for slideably extending said handle longitudinally outward of said tube in combination with a spur and coacting spaced notches on said toothbrush and tube for retaining said handle in stored and extended positions whereby said tube provides a handle extension for said toothbrush: further including a transverse tab on said toothbrush behind said container parallel and adjacent to said end wall, said tab being integral with said rear end of said toothbrush adapted to eject said container when the toothbrush is extended, in further combination with a front end closure which adhesively engages the toothbrush and partially extracts the toothbrush upon being opened.

* * * * *